US006733313B2

(12) United States Patent
Shinozaki et al.

(10) Patent No.: US 6,733,313 B2
(45) Date of Patent: May 11, 2004

(54) CONNECTOR HAVING AN OPERABLE MEMBER AND A CONNECTOR ASSEMBLY

(75) Inventors: Tetsuya Shinozaki, Yokkaichi (JP); Keigo Atsumi, Yokkaichi (JP); Masanori Wakui, Toyota (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/375,756

(22) Filed: Feb. 26, 2003

(65) Prior Publication Data

US 2003/0166351 A1 Sep. 4, 2003

(30) Foreign Application Priority Data

Feb. 26, 2002 (JP) ..... 2002-049504

(51) Int. Cl.[7] ..... H01R 13/62
(52) U.S. Cl. ..... 439/157; 439/372
(58) Field of Search ..... 439/157, 160, 439/152–153, 159, 372, 350, 352

(56) References Cited

U.S. PATENT DOCUMENTS 5,171,156 A * 12/1992 Nagasaka et al. ..... 439/157
5,201,665 A * 4/1993 McCardell et al. ..... 439/157
5,790,373 A * 8/1998 Kim et al. ..... 439/160
5,924,880 A * 7/1999 Watanabe et al. ..... 439/157
6,193,532 B1 * 2/2001 Smithson ..... 439/157
6,293,813 B1 * 9/2001 Johnston et al. ..... 439/157
6,354,164 B1 * 3/2002 Megason et al. ..... 439/157
6,471,527 B2 * 10/2002 Fukamachi et al. ..... 439/157
6,544,053 B2 * 4/2003 Hahn et al. ..... 439/157
6,549,424 B1 * 4/2003 Beseth et al. ..... 439/157
2001/0046798 A1 * 11/2001 Noro et al. ..... 439/157
2001/0053621 A1 * 12/2001 Muramatsu et al. ..... 439/157

FOREIGN PATENT DOCUMENTS

JP 08-180930 7/1996

* cited by examiner

*Primary Examiner*—Renee Luebke
*Assistant Examiner*—Felix O. Figueroa
(74) *Attorney, Agent, or Firm*—Anthony J. Casella; Gerald E. Hespos

(57) ABSTRACT

A lever (40) of a connector assembly is in the form of a single plate, and a resilient lock (48) for locking the lever (40) at a connection completing position and a finger placing portion (47B) used to rotate the lever (40) are adjacent to each other at one end of the lever (40). The resilient lock (48) extends along the plane of the lever (40) and is resiliently deformable along a direction normal to the plane. Thus, a larger area can be secured for an unlocking portion (48B) of the resilient lock (48) without increasing the thickness of the lever (40), thereby providing good unlocking operational efficiency.

16 Claims, 13 Drawing Sheets

CONNECTOR HAVING AN OPERABLE MEMBER AND A CONNECTOR ASSEMBLY

BACKGROUND OF THE INVENTION

1. Field of the Invention

The invention relates to a connector having an operable member and to a connector assembly.

2. Description of the Related Art

A lever-type connector assembly has first and second connectors that are connectable with each other. The first connector has a housing and a lever is mounted to the housing to assist in the connection of the first and second connectors. The lever typically is U-shaped and has two cam plates formed respectively with cam grooves, and an operable portion that connects the two cam plates. The cam plates are mounted rotatably on supporting shafts at opposite side surfaces of the housing so that the lever is right outside the opposite side surfaces of the housing. The lever first is set at an initial position, and cam pins that project from the second connector are engaged with the cam grooves of the lever. The lever then is rotated to a connection completing position, and a cam action between the cam pins and the cam grooves pulls the connectors toward one another. A connector with such a gate-shaped lever is disclosed, for example, in Japanese Patent Publication No. 8-180930.

The above-described connector can have an operable portion with a resilient lock for locking the lever at the connection completion position. The resilient lock is deformable along a direction normal to a rotational axis of the lever and engages the housing or the second connector when the lever is brought to the connection completing position. The resilient lock also has an unlocking portion. The two connectors can be separated from each other by pushing the unlocking portion with a finger to deform the resilient lock and to disengage the resilient lock from the housing. Thus, the lever can be returned toward the initial position.

Efforts have been made to miniaturize the above-described lever-type connectors by forming the entire lever as a single plate. Such connectors are likely to have a resilient lock that is resiliently deformable along a direction normal to the rotational axis of a lever, as in the prior art. The unlocking portion desirably should have a large area to facilitate actuation by a finger. However, a larger area for the unlocking portion necessarily increases the thickness of the lever, and therefore impedes miniaturization efforts.

The invention was developed in view of the above problem and an object thereof is to provide a connector and connector assembly with a good unlocking operability while enabling an operable member to be thinned.

SUMMARY OF THE INVENTION

The invention relates to a connector that is connectable with a mating connector. An operable member is mounted on the connector and is held at an initial position for engagement with the mating connector. The operable member then is moved to a connection completing position to pull the two connectors toward each other and to connect the two connectors by a cam action effected between the operable member and the mating connector. The operable member comprises a resilient lock for locking the operable member at the connection completing position. The resilient lock is formed with an unlocking portion for canceling the locked state of the operable member. Additionally, the resilient lock extends substantially along a surface of the operable member and is resiliently deformable at an angle, and preferably a right angle, to the operable member surface. Accordingly, a large area can be secured for the unlocking portion without increasing the thickness of the operable member, thereby providing a good unlocking operability.

The operable member preferably is a lever rotatably mounted on the connector.

The operable member preferably is in the form of a single plate, and hence provides a thin dimension, as compared to U-shaped operable members. Additionally, the resilient lock extends substantially along the plane of the operable member and is resiliently deformable at an angle to the plane of the operable member. Thus, a larger area can be secured for the unlocking portion without increasing the thickness of the lever, thereby providing a good unlocking operability and supporting miniaturization efforts.

A finger placing portion preferably is provided at one end of the operable member and near the unlocking portion for moving the operable member from the connection completing position toward the initial position. Thus, the unlocking operation can be performed easily by one hand.

The finger placing portion preferably is at a leading end of the operable member and the unlocking portion is more toward the base end of the operable member. Accordingly, the unlocking operation can be performed, for example, by pushing the unlocking portion by the thumb of one hand and pulling the finger placing portion by the forefinger of this hand.

The operable member preferably has at least one cam plate with at least one resilient locking piece that is engageable with a housing of the connector to hold the operable member at the initial position. The resilient locking piece preferably is resiliently deformable at an angle, and preferably a right angle, to a rotation axis of the lever. Accordingly, a space needed for the resilient deformation of the resilient locking piece is reduced and no space is needed for permitting the resilient deformation of the resilient locking piece in the thickness direction as in the prior art. As a result, the connector assembly can be made smaller.

The resilient locking piece preferably is resiliently deformable in a direction different from the lock, and preferably substantially normal thereto.

The mating connector may have a cam means for engaging a mating cam means in the cam plate. The cam means may be a cam pin and the mating cam means may be a cam groove in the cam plate.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
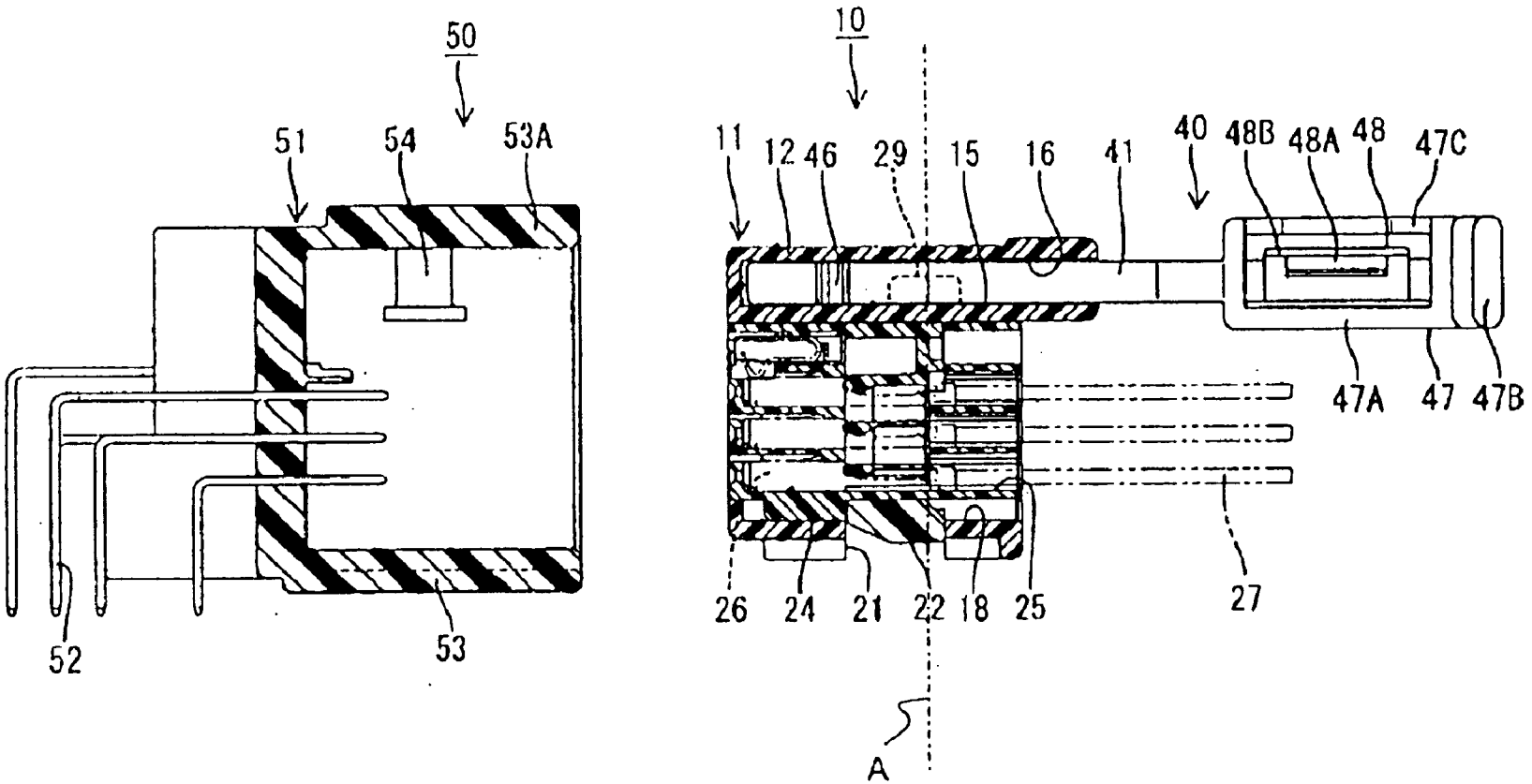
FIG. 1 is an exploded longitudinal section of female and male connectors of the invention showing a state before the two connectors are connected.
Figure 2:
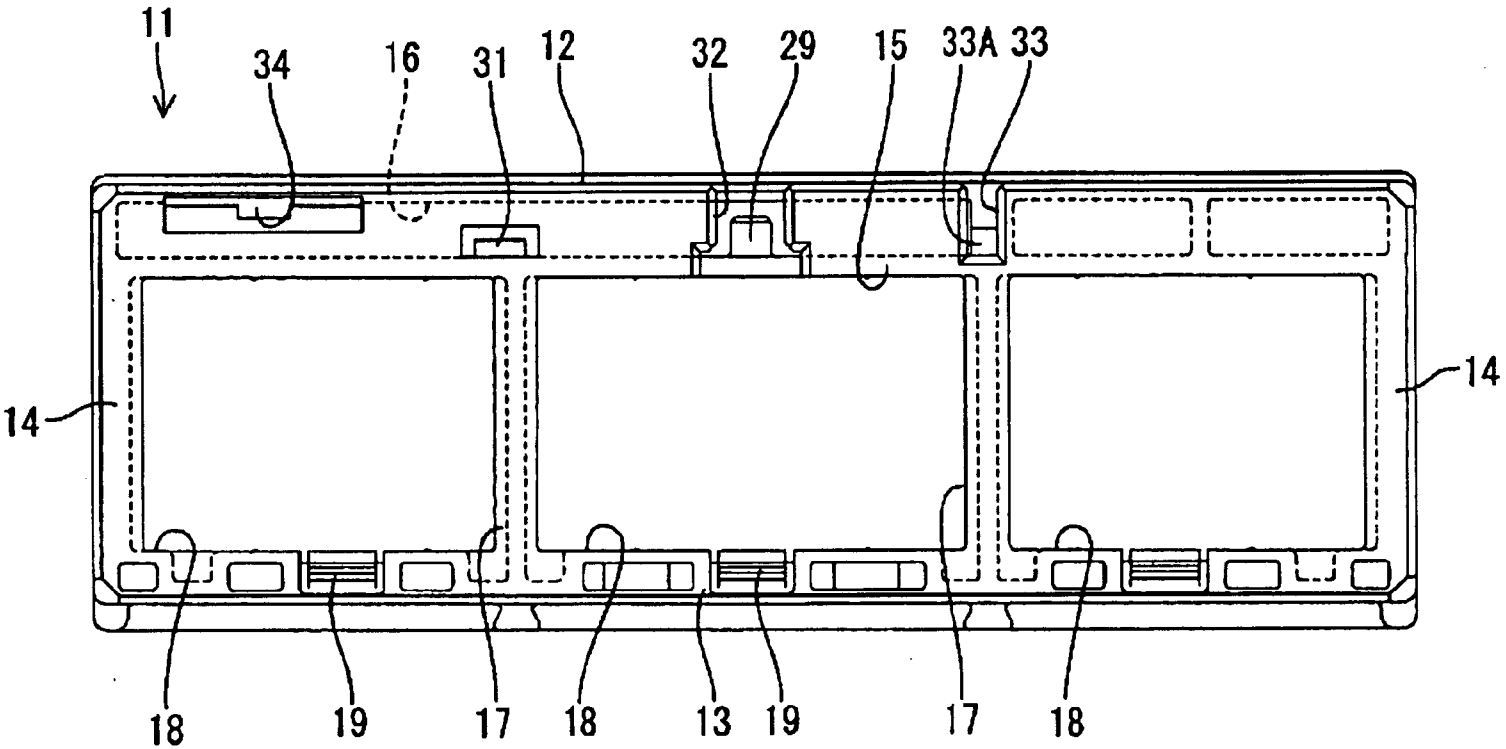
FIG. 2 is a front view of a holder.
Figure 3:
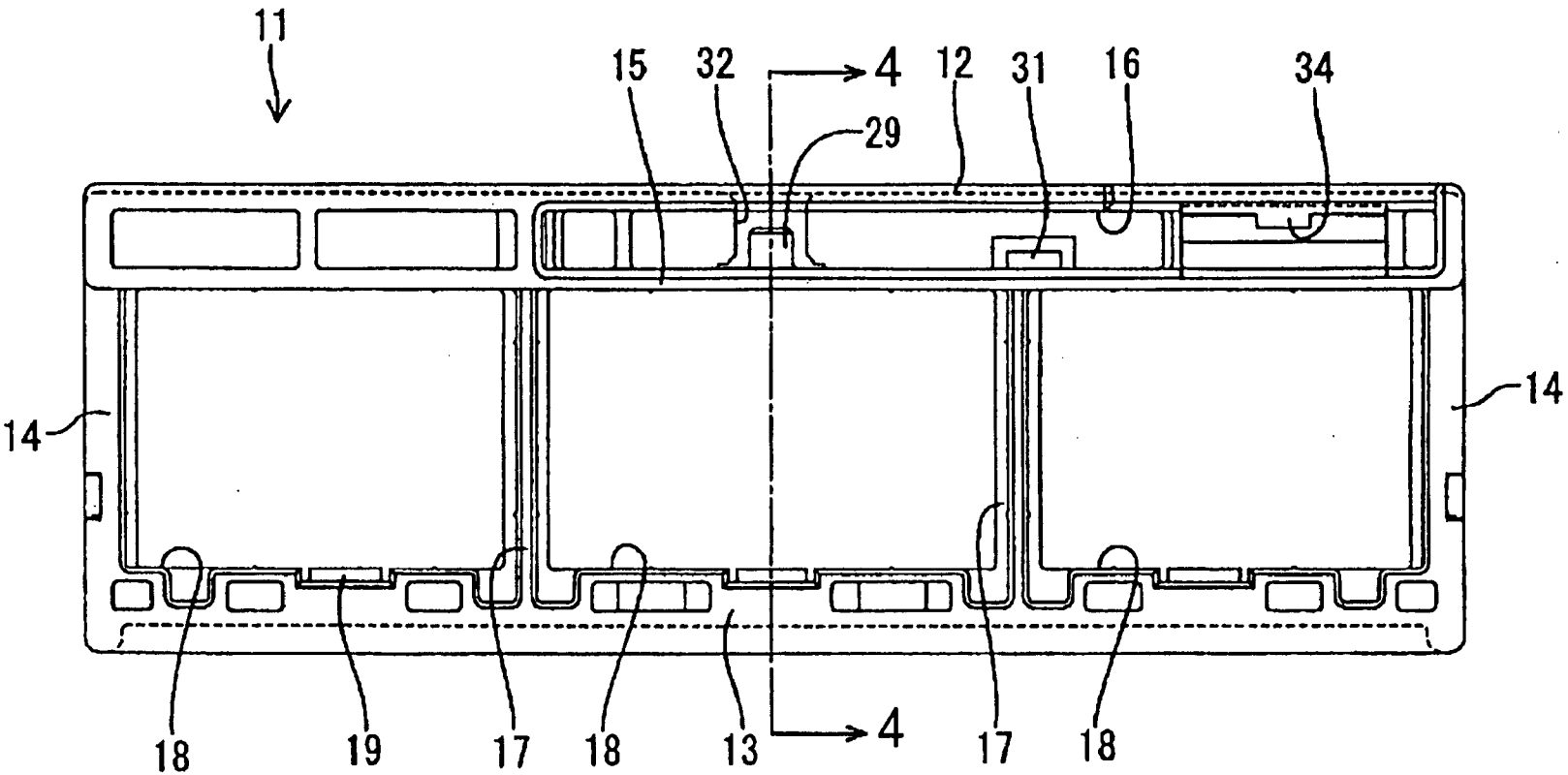
FIG. 3 is a rear view of the holder.
Figure 4:
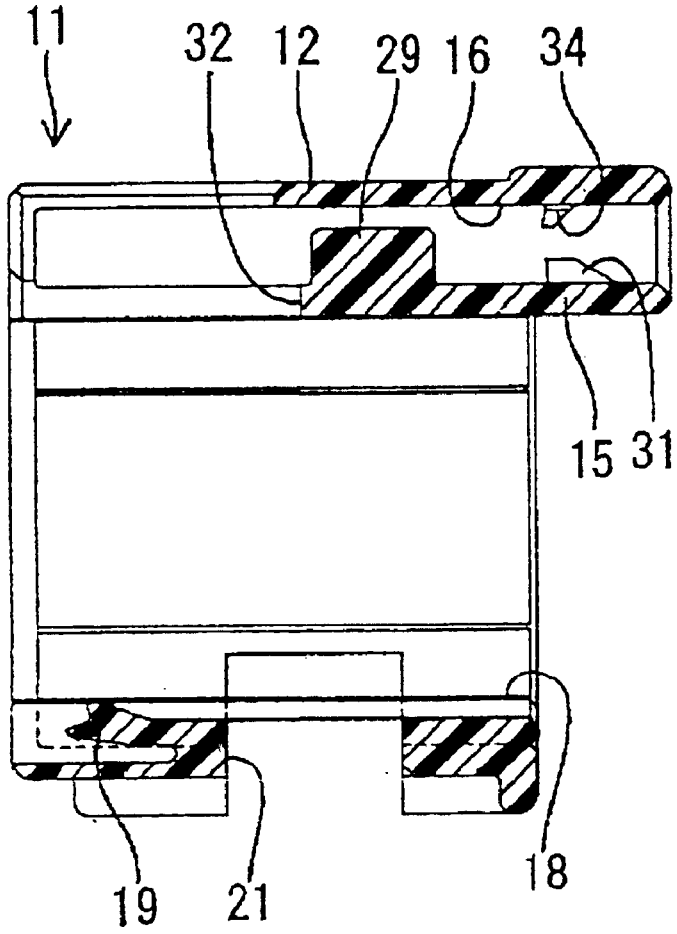
FIG. 4 is a section along 4—4 of FIG. 3.

A lever-type connector assembly according to the invention has a female connector 10 and a male connector 50 that are connectable with and separable from each other as shown in FIGS. 1 to 14. The side of each connector 10, 50 that is to be connected with a mating side is referred to as the front side in the following description.

The female connector 10 has a frame-shaped holder 11, as shown in FIGS. 2 to 5. The holder 11 is formed e.g. of a synthetic resin and defines a wide rectangular frame that is hollow in forward and backward directions. The holder 11 has an upper wall 12, a lower wall 13 and left and right side walls 14. A ceiling wall 15 is formed between the upper and lower walls 12 and 13 and nearer the upper wall 12. Thus, a narrow accommodating recess 16 is defined between the upper wall 12 and the ceiling wall 15. Partition walls 17 extend between the ceiling wall 15 and the lower wall 13 to define transversely arranged mount spaces 18. The lower wall 13 is formed with resiliently deformable locks 19 corresponding to the respective mount spaces 18. Further, a wide recess 21 across the lower wall 13 of the holder 11, and a retainer 22 is fit into the recess 21 from below.

The connector assembly also includes auxiliary connectors 24. Each auxiliary connector 24 is substantially block shaped and is formed e.g. of a synthetic resin (see FIG. 1). Cavities 25 are formed in each auxiliary connector 24, and female terminal fitting 26 are inserted respectively into the cavities 25 from behind. Further, a wire 27 is secured to each female terminal fitting 26 and is drawn out backward through the rear end of the auxiliary connector 24. Each auxiliary connector 24 is inserted from behind into the corresponding mount space 18 of the holder 11. In a mounted state, the front and rear end surfaces of the auxiliary connectors 24 are substantially flush with the front and rear ends of the holder 11. Thus, the auxiliary connectors 24 are locked doubly by the locks 19 and the retainer 22 fitted in the recess 21.

A supporting shaft 29 projects up from the ceiling wall 15 in the accommodating recess 16 of the holder 11. The supporting shaft 29 has front and rear surfaces that define arcs of a cylinder of diameter D. However, the supporting shaft 29 also includes opposite parallel flat sides 29A that define chordal planes of the cylinder. The flat sides 29A are spaced apart by a transverse dimension W.

A stopper 31 projects on the upper surface of the ceiling wall 15 in the accommodating recess 16 of the holder 11. Additionally, a center escaping groove 32 is formed in the upper wall 12 and the ceiling wall 15 of the holder 11 and a side escaping groove 33 is formed at one side of the accommodating recess 16 of the holder 11. The escaping groove 33 extends back from the front surface of the holder 11, and a receiving portion 33A projects in the lower rear of the escaping groove 33.

Figure 5:
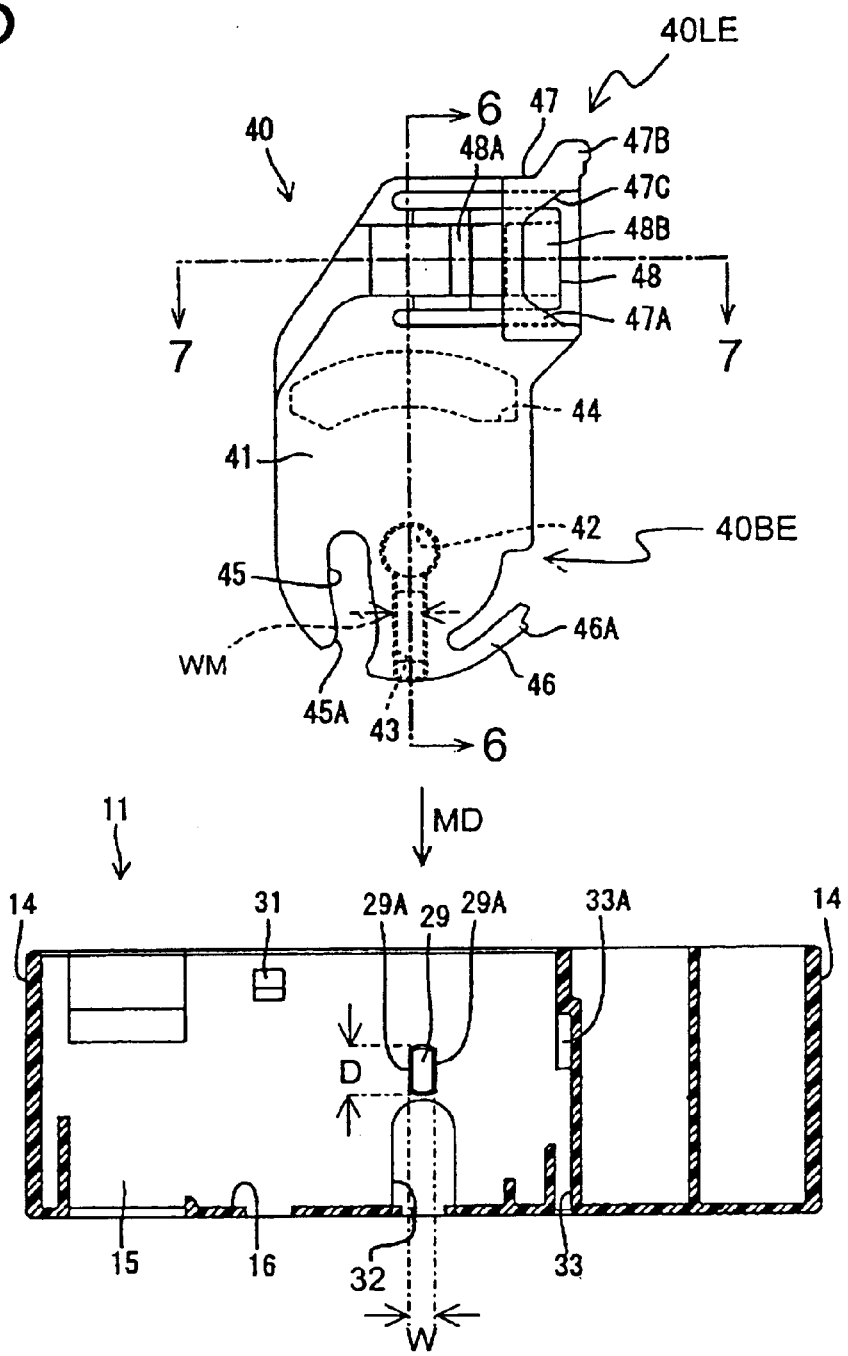
FIG. 5 is a horizontal section showing a state before a lever is mounted into the holder.
Figure 6:
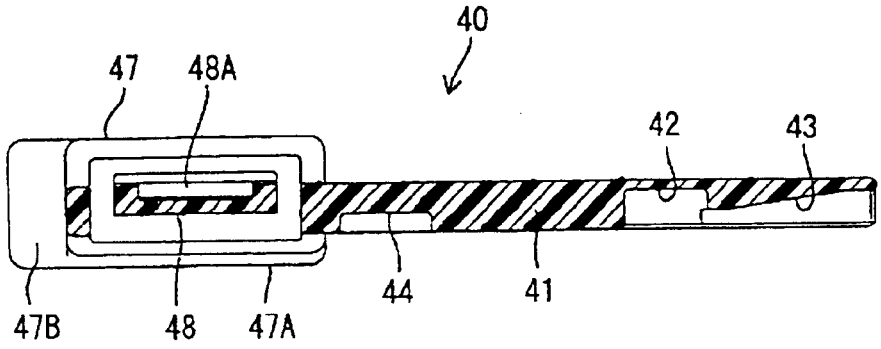
FIG. 6 is a section along 6—6 of FIG. 5.
Figure 7:
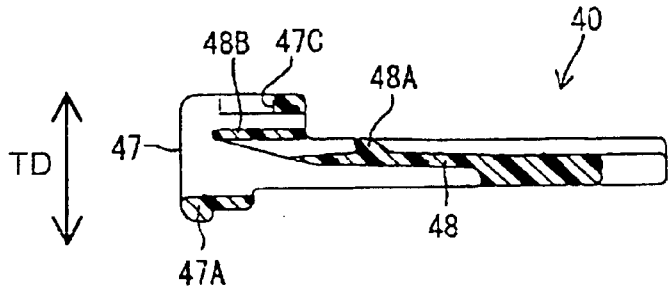
FIG. 7 is a section along 7—7 of FIG. 5.

The connector assembly further includes a lever 40, as shown in FIGS. 5 to 7. The lever 40 is formed e.g. of a synthetic resin into the shape of a single planar cam plate 41. A substantially round bearing hole 42 is formed near one end of the lower surface of the cam plate 41, and has a diameter slightly greater than the diametrical dimension D of the supporting shaft 29. Thus, the bearing hole 42 can receive the supporting shaft 29 of the holder 11. A portion of the lever 40 is accommodated in the accommodating recess 16 so that the cam plate 41 is held between the upper wall 12 and the ceiling wall 15 while defining a small clearance to each of the upper and ceiling walls 12 and 15. Additionally, the bearing hole 42 of the cam plate 41 receives the supporting shaft 29 so that the lever 40 is rotatable about the supporting shaft 29.

A mount groove 43 is formed in the lower surface of the cam plate 41 and extends from the bearing hole 42 to the outer edge of the cam plate 41 substantially along the longitudinal direction of the cam plate 41, which is the mounting direction MD of the lever 40 to the holder 11. The mount groove 43 guides the supporting shaft 29 to the bearing hole 42 when the lever 40 is mounted into the holder 11. The mount groove 43 has a width WM that is slightly larger than the transverse dimension W between the flat sides 29A the supporting shaft 29. Further, the depth of the mount groove 43 is less than the projecting distance of the supporting shaft 29 and the depth becomes gradually smaller toward the bearing hole 42 (see FIG. 6). Thus, a step is defined between the bottom surface of the bearing hole 42 and the bottom of the mount groove 43.

A rotation guiding groove 44 is formed in the lower surface of the cam plate 41 and is substantially in the form of a fan with a center at the bearing hole 42. The stopper 31 on the upper surface of the ceiling wall 15 in the accommodating recess 16 of the holder 11 engages the rotation guiding groove 44. Thus, a rotatable range of the lever 40 is defined by the ends of the rotation guiding groove 44 along which the stopper 31 is displaceable. More particularly, the lever 40 is rotatable between an initial position shown in FIG. 10 and a connection completing position shown in FIG. 13. Further, a cam groove 45 is formed in the cam plate 41 near the bearing hole 42, and an opening 45A of the cam groove 45 is at the outer edge of the cam plate portion 41. When the lever 40 is at the initial position, the opening portion 45A of the cam groove 45 is substantially aligned with the escaping groove 32, whereby the cam groove 45 is ready for at least partly receiving the cam pin 54.

A resilient locking piece 46 is cantilevered at an end of the cam plate 41 and at side substantially opposite the cam groove 45 with respect to the mount groove 43. The resilient locking piece 46 extends substantially along the plane of the cam plate 41. The width (vertical dimension) of the resilient locking piece 46 is the same as the thickness of the cam plate 41, and the leading end of the resilient locking piece 46 is resiliently deformable substantially along the plane of the cam plate 41 or substantially parallel thereto. Further, a projection 46A projects outward at the leading end of the resilient locking piece 46.

The projection 46A of the resilient locking piece 46 enters the escaping groove 33 when the lever 40 is at the initial position, and the lower half of the projection 46A engages the receiving portion 33A for locking. Thus, rotation of the lever 40 toward the connection completing position is prevented.

The lever 40 also has an operable portion 47 at an end of the cam plate 41 substantially opposite from the bearing hole 42. The operable portion 47 is near the rear surface side of the holder 11 at the connection completing position. The operable portion 47 has a substantially rectangular frame 47A that bulges out from the cam plate 41 in the thickness direction of the cam plate 41 and a finger placing portion 47B that bulges out from the rectangular frame 47A in a direction away from the bearing hole 42. Further, a planar resilient lock 48 is cantilevered substantially in the plane of the cam plate 41 from the end of the lever 40 that has the operable portion 47 and is configured for locking the lever 40 at the connection completing position. The resilient lock 48 extends back when the lever 40 is at the connection completing position, and is resiliently deformable substantially in its thickness direction TD, which is normal to the plane of the cam plate 41 and in plane parallel to the rotational axis of the lever 40. A locking projection 48A is provided on the upper surface of the resilient lock 48. The locking projection 48A is engageable with a claw 34 on the upper wall 12 of the holder 11 when the lever 40 is substantially at the connection completing position. Further, an unlocking portion 48B in the form of a substantially flat plate is provided at the leading end of the resilient lock 48 for disengaging the locking projection 48A from the claw 34. The unlocking portion 48B is inside the substantially rectangular frame 47A, and a notch 47C is formed in the upper surface of the substantially rectangular frame 47A to expose the unlocking portion 48B. In other words, the finger placing portion 47B and the unlocking portion 48B are near each other at the leading end 40LE of the lever 40. However, the finger placing portion 47B is more toward the leading end 40LE of the lever 40 and the unlocking portion 48B is provided more toward the base end 40BE of the lever 40 and thus more toward the bearing hole 42 than the finger placing portion 47B. Additionally, the finger placing portion 47B is radially more outward than the unlocking portion 48B with respect to the axis A of rotation of the lever 40.

Figure 8:
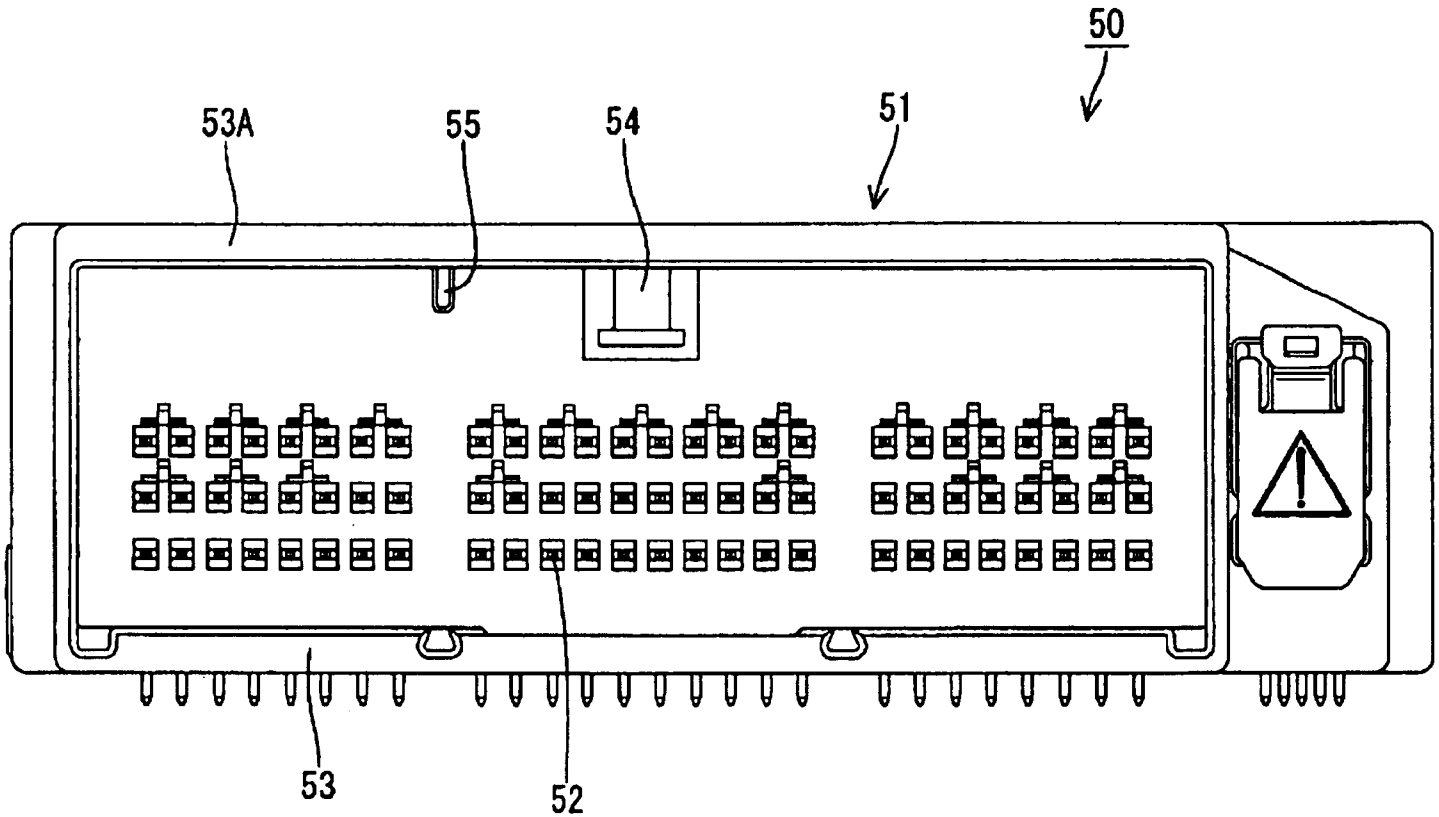
FIG. 8 is a front view of a male connector.
Figure 10:
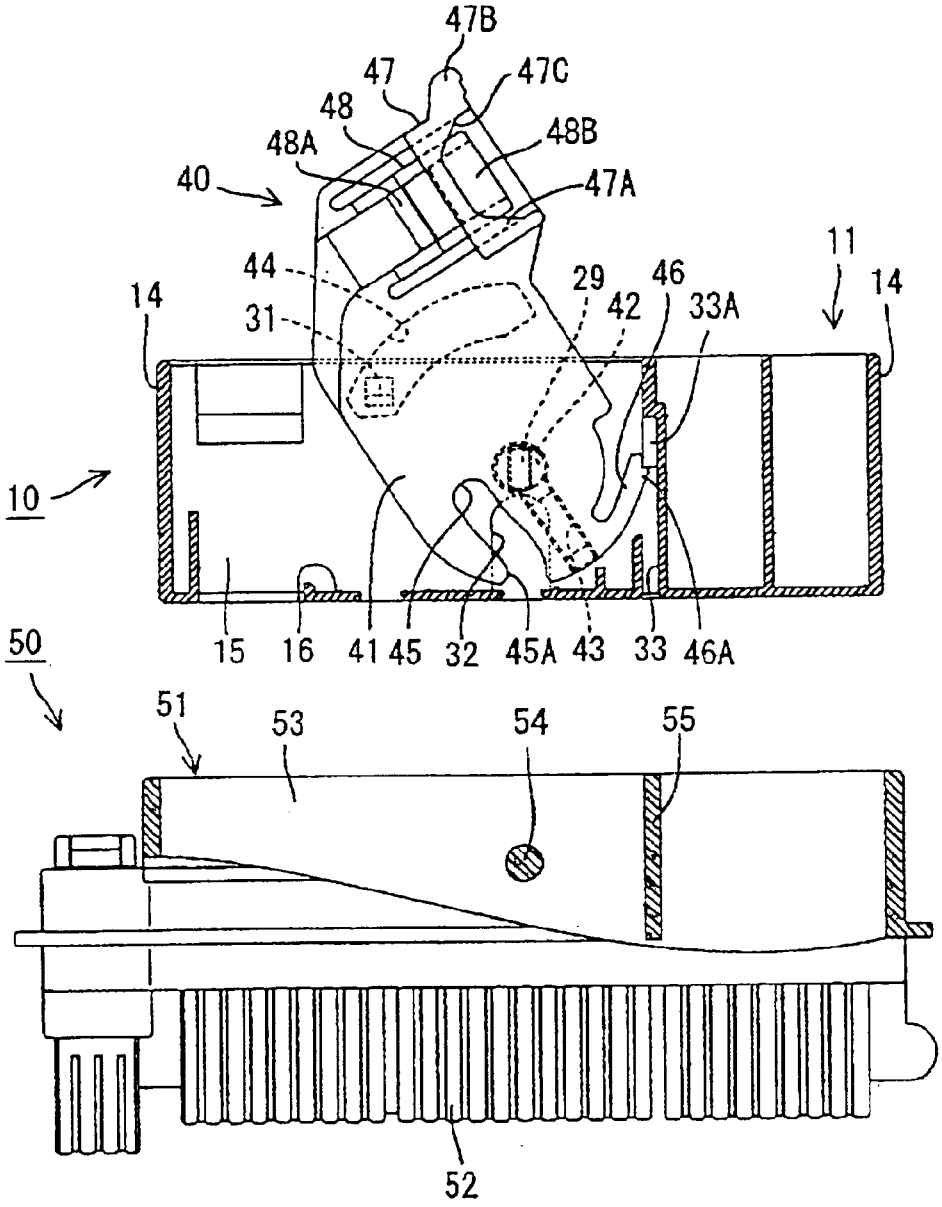
FIG. 10 is a horizontal section showing a state before the female and male connectors are connected.

The male connector 50 has a housing 51 formed e.g. of a synthetic resin and male terminal fittings 52 are mounted in the housing 51, as shown in FIGS. 1, 8 and 10. A substantially rectangular receptacle 53 opens at the front side of the housing 51, and the holder 11 of the female connector 10 is insertable into the receptacle 53. The male terminal fittings 52 project into the receptacle 53 from the rear end thereof. Thus, the male and female terminal fittings 52 and 26 connect with each other when the connectors 10, 50 are connected properly.

A cylindrical cam pin 54 and an unlocking rib 55 project down from an upper plate 53A of the receptacle 53 towards the inner space of the receptacle 53. The unlocking rib 55 extends from the front end of the receptacle 53 along forward and backward directions and enters the upper half of the escaping groove 33 when the male connector 50 connects with the female connector 10.

The connector assembly is assembled by first placing the cam plate 41 of the lever 40 substantially parallel to the upper wall 12 of the holder 11, as shown in FIG. 5. The cam plate 41 then is inserted into the accommodating recess 16 of the holder 11 so that the width direction of the mount groove 43 conforms to the width W of the supporting shaft 29, thereby guiding the supporting shaft 29 into the mount groove 43. The upper wall 12 and the ceiling wall 15 near the supporting shaft 29 deform slightly away from each other when the supporting shaft 29 is pushed into the mount groove 43 to permit passage of the supporting shaft 29. The depth of the mount groove 43 becomes gradually smaller toward the bearing hole 42 (see FIG. 6). Thus, the supporting shaft 29 easily can be pushed deeper into the mount groove 43. The upper wall 12 and the ceiling wall 15 are restored resiliently to their original shapes, as the supporting shaft 29 reaches the bearing hole 42, thereby engaging the supporting shaft 29 with the bearing hole 42 (see FIG. 9).

Figure 9:
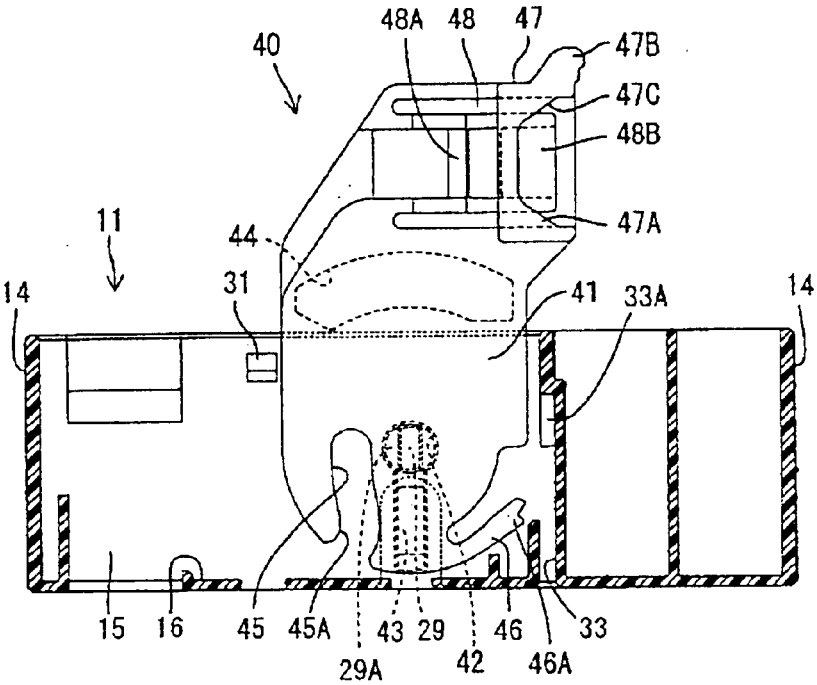
FIG. 9 is a horizontal section showing a state where the lever is inserted in the holder.

Assembly proceeds by rotating the lever 40 counterclockwise from the state shown in FIG. 9. Thus, the stopper 31 is pushed under the cam plate 41, and the upper wall 12 and the ceiling wall 15 near the stopper 31 deform slightly away from each other. The lever 40 then is rotated to the initial position shown in FIG. 10 so that the stopper 31 is fit into the rotation guiding groove 44. As a result, the upper wall 12 and the ceiling wall 15 are restored resiliently to their original shapes. Accordingly, the projection 46A of the resilient lock 46 enters the escaping groove 33 and engages the receiving portion 33A to prevent rotation of the lever 40 toward the connection completing position. The orientation of the supporting shaft 29 in the bearing hole 42 deviates from the orientation of the mount groove 43 when the lever 40 is rotated in the state shown in FIG. 9. Thus, the lever 40 is locked so as not to come out. In this way, the mounting operation of the lever 40 into the holder 11 is completed.

Each auxiliary connector 24 then is fit into the corresponding mount space 18 of the holder 11, as shown in FIG. 1, and the retainer 22 is brought into engagement with the auxiliary connectors 24 to lock the auxiliary connectors 24 so as not to come out.

Figure 11:
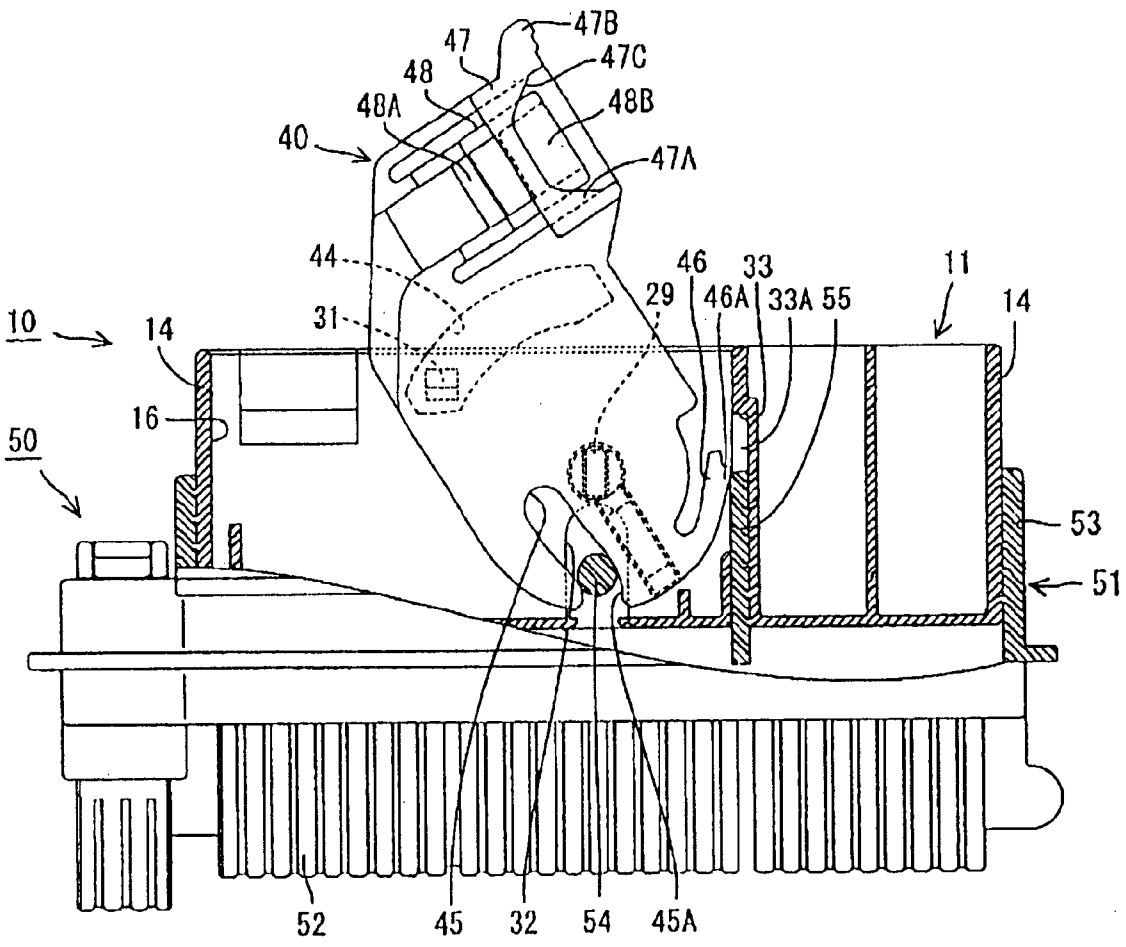
FIG. 11 is a horizontal section showing an initial stage of connection of the female and male connectors.

The holder 11 of the female connector 10 then is inserted lightly into the receptacle 53 of the male connector 50. Thus, the cam pin 54 fits into the opening 45A of the cam groove 45, as shown in FIG. 11, and the unlocking rib 55 contacts the projection 46A of the resilient lock 46. As a result, the resilient lock 46 deforms and disengages from the receiving portion 33A so that the lever 40 can rotate. An attempt could be made to insert the female connector 10 into the receptacle 53 upside down. However, such insertion will bring the leading end of the unlocking rib 55 into contact with the holder 11, thereby preventing further insertion.

The lever 40 then is rotated toward the connection completing position by pushing the operable portion 47. As a result, the cam action between the cam groove 45 and the cam pin 54 pulls the connectors 10, 50 toward each other so that the holder 11 is fit further into the receptacle 53. A force resulting from connecting resistance acts upon the lever 40 during the connecting operation. However, the cam plate 41 is held substantially from the opposite sides along the thickness direction TD in the accommodating recess 16. Consequently, the cam plate 41 will not deform substantially in the direction of the rotational axis and will not disengage from the supporting shaft 29.

Figure 12:
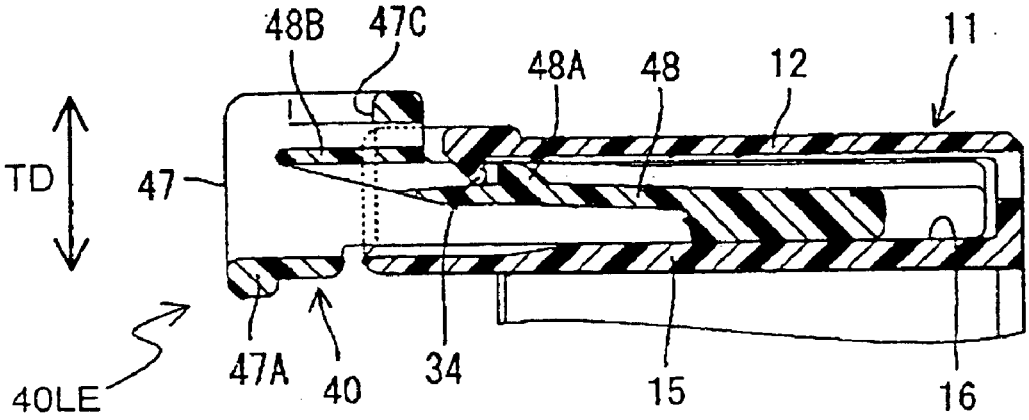
FIG. 12 is a partial enlarged longitudinal section showing a state where the lever is locked at a connection completing position.

The locking projection 48A of the resilient locking piece 48 contacts the claw 34 of the holder 11 when the lever 40 comes closer to the connection completing position. Thus, the resilient locking piece 48 is deformed resiliently in a direction substantially normal to the plane of the cam plate 41. The resilient locking piece 48 is restored resiliently towards its original shape when the lever 40 reaches the connection completing position and the locking projection 48A and the claw 34 engage to lock the lever 40 as shown in FIG. 12. As a result, the two connectors 10, 50 are connected properly (see FIGS. 13 and 14).

Figure 13:
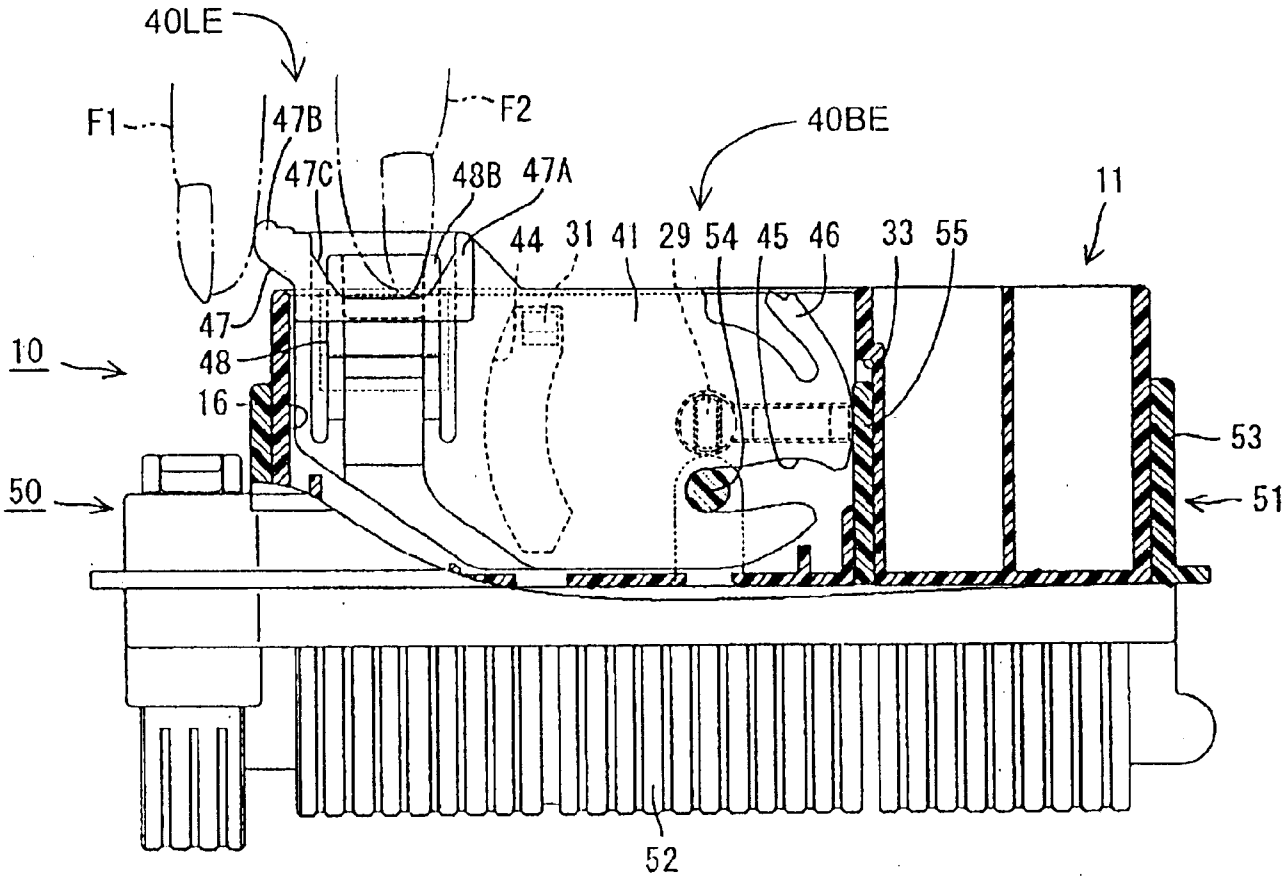
FIG. 13 is a horizontal section showing a state where the connection of the female and male connectors is completed.
Figure 14:
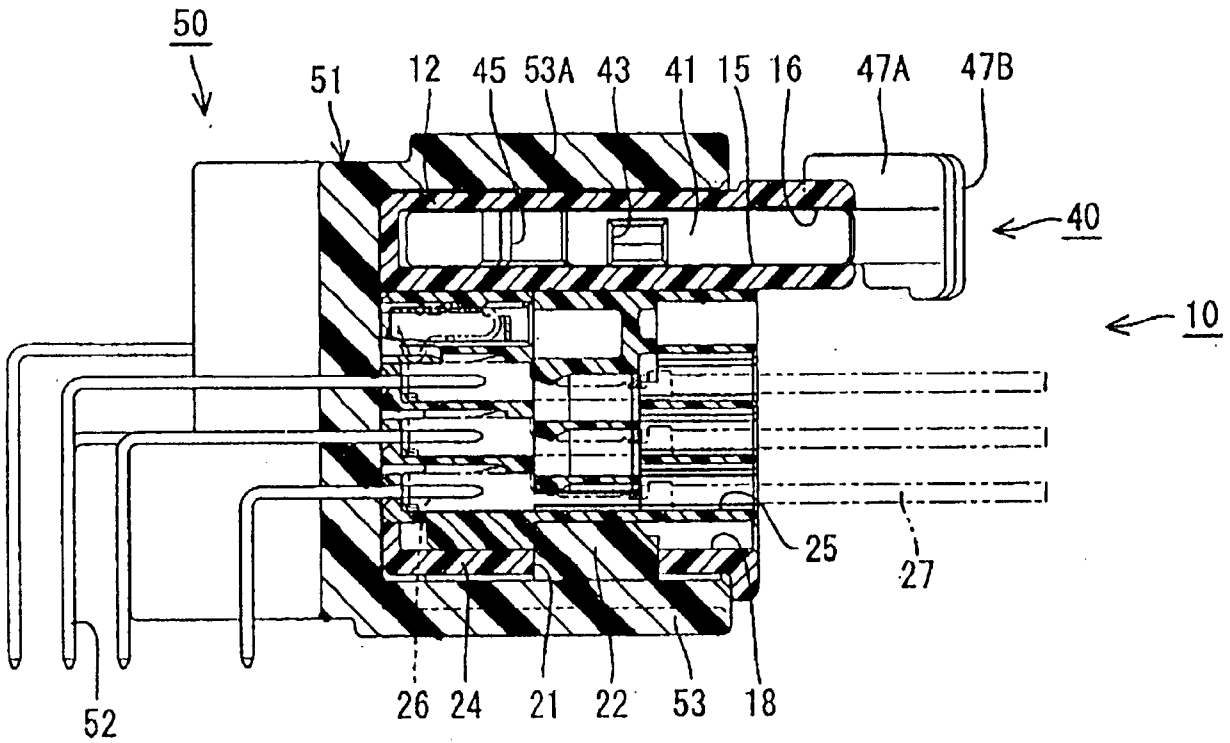
FIG. 14 is a longitudinal section showing a state where the connection of the female and male connectors is completed.

The two connectors 10, 50 can be separated by placing a forefinger F1 on the finger placing portion 47B of the operable portion 47 and pushing down on the unlocking portion 48B of the resilient lock 48 with the tip of the thumb F2 of the same hand, as shown in FIG. 13. Thus, the lever 40 is unlocked and the operable portion 47 is pulled to rotate the lever 40 clockwise in FIG. 13. As a result, the cam pin 54 is displaced along the cam groove 45 toward the opening portion 45A, and the two connectors 10, 50 move apart. The cam pin 54 comes out of the cam groove 45 when the lever 40 reaches the initial position, and the two connectors 10, 50 are separated from each other.

As described above, the lever 40 has a plate shape. Further, the resilient lock 48 extends along plane of the lever 40 and is resiliently deformable at an angle to the plane of the lever 40. Thus, a larger area can be secured for the unlocking portion 48B without increasing the thickness of the lever 40, thereby providing a good unlocking operability.

Further, the finger placing portion 47B and the unlocking portion 48B are near each other at one end of the lever 40. Thus, the unlocking operation can be performed easily by one hand.

The invention is not limited to the above described and illustrated embodiment. For example, the following embodiments are also embraced by the technical scope of the present invention as defined in the claims. Beside the following embodiments, various changes can be made without departing from the scope and spirit of the present invention as defined in the claims.

In the foregoing embodiment, the lever is mounted in the holder of the split-type connector. However, the lever also may be mounted in housings of connectors other than the split-type connector.

The resilient lock is engageable with the housing on which the lever is mounted in the foregoing embodiment. However, the resilient lock may be engageable with the mating connector according to the present invention.

The invention has been described with reference to a lever as an operable member for assisting or effecting the connection of the two connectors. However, the invention also is applicable to other types of movable members, such as a substantially linearly displaceable slider that displays a cam action between the two connectors.

What is claimed is:

1. A connector being connectable with a mating connector, comprising:

an operable member having a substantially planar plate mounted on the connector and engageable with the mating connector, wherein:

the operable member having an initial position for engagement with the mating connector, and being movable to a connection completing position for pulling the connectors toward each other and into connection by a cam action between the operable member and the mating connector, the operable member comprises a resilient lock for locking the operable member at the connection completing position, the resilient lock being formed with an unlocking portion for canceling a locked state of the operable member by the resilient lock, and the resilient lock extends substantially along the substantially planar plate of the operable member and being resiliently deformable along a direction substantially normal to the substantially planar plate.

2. The connector of claim 1, wherein the operable member is a lever rotatably mounted on the connector.

3. The connector of claim 2, wherein a finger placing portion is provided at one end of the operable member of the lever and adjacent to the unlocking portion, the finger placing portion being configured for rotating the lever from the connection completing position toward the initial position.

4. The connector of claim 3, wherein the lever has a base end and an opposite leading end, the finger placing portion being at the leading end of the lever, and the unlocking portion being more toward the base end of the lever than the finger placing portion.

5. The connector of claim 1, wherein the operable member has at least one cam plate with at least one resilient locking piece releasably engageable with a housing of the connector for holding the operable member at the initial position.

6. The connector of claim 5, wherein the operable member is a lever rotatable about a rotation axis, and wherein the locking piece is resiliently deformable in a direction substantially normal to the rotation axis of the lever.

7. A connector assembly comprising the connector of claim 1 and a mating connector connectable therewith.

8. The connector assembly of claim 7, wherein a cam means provided at the mating connector is engageable with a mating cam means formed in the operable portion.

9. The connector assembly of claim 8, wherein the cam means comprises a cam pin provided at the mating connector and the mating cam means comprising a cam groove formed in the operable portion and engageable with the cam pin.

10. A connector for connection with a mating connector, comprising:

a lever having a substantially planar cam plate mounted on the connector, the lever having an initial position for engagement with the mating connector and being movable to a connection completing position for pulling the connectors towards each other and into connection by a cam action between the lever and the mating connection;

at least one resilient locking piece formed on the cam plate and being releasably engageable with a housing of the connector for holding the lever at the initial position; and a resilient lock formed on the lever and spaced from the resilient locking piece for locking the lever at the connection completing position, the resilient lock being formed with an unlocking portion for canceling a locked state of the lever by the resilient lock, the resilient lock extending substantially along the substantially planar cam plate of the lever and wherein the resilient lock is resiliently deformable in a direction substantially normal to the locking piece and substantially normal to the cam plate.

11. A connector assembly comprising:

a first connector;

a second connector connectable with the first connector, the second connector having a cam formed thereon; and a lever mounted on the first connector for rotation about a rotational axis between an initial position and a connection completing position, the lever having a mating cam configured for mating with the cam of the second connector when the lever is in the initial position and for pulling the connectors toward each other as the lever is rotated to the connection completing position, the lever comprising a resilient lock for locking the lever at the connection completing position, the resilient lock being formed with an unlocking portion for canceling a locked state of the lever by the resilient lock, and the resilient lock being resiliently deformable about an axis substantially normal to the rotational axis of the lever, wherein the lever is a single plate defining a plane, and the resilient lock extending substantially along the plane of the plate of the lever and being deformable along a direction substantially normal to the plane of the plate.

12. The connector assembly of claim 11, wherein a finger placing portion is provided at one end of the lever and adjacent to the unlocking portion, the finger placing portion being configured for rotating the lever from the connection completing position toward the initial position.

13. The connector assembly of claim 12, wherein the lever has a base end defining a portion of the lever mounted to the first connector, the lever further having an opposite leading end, the finger placing portion being at the leading end of the lever, and the unlocking portion being more toward the base end of the lever than the finger placing portion.

14. A connector assembly comprising:

a first connector;

a second connector connectable with the first connector, the second connector having a cam formed thereon; and a lever having a substantially planar cam plate mounted on the first connector for rotation between an initial position and a connection completing position, the lever having a mating cam configured for mating with the cam of the second connector when the lever is in the initial position and for pulling the connectors toward each other as the lever is rotated to the connection completing position, the lever comprising a resilient lock for locking the lever at the connection completing position, the resilient lock being cantilevered to lie substantially in the plane of the cam plate in an undeformed condition of the resilient lock, the resilient lock being resiliently deformable in a direction substantially normal to the plane of the cam plate.

15. The connector assembly of claim 14, wherein the resilient lock is formed with an unlocking portion for canceling a locked state of the lever by the resilient lock, and wherein a finger placing portion is provided at one end of the lever and adjacent to the unlocking portion, the finger placing portion being configured for rotating the lever from the connection completing position toward the initial position.

16. The connector assembly of claim 15, wherein the lever has a base end defining an end of the lever mounted to the first connector, the lever further having a leading end opposite the base end, the finger placing portion being at the leading end of the lever, and the unlocking portion being more toward the base end of the lever than the finger placing portion.

* * * * *